US005633984A

United States Patent [19]

Aso et al.

[11] Patent Number: 5,633,984

[45] Date of Patent: May 27, 1997

[54] METHOD AND APPARATUS FOR SPEECH PROCESSING

[75] Inventors: Takashi Aso; Yasunori Ohora, both of Yokohama; Takeshi Fujita, Kawasaki, all of Japan

[73] Assignee: Canon Kabushiki Kaisha, Tokyo, Japan

[21] Appl. No.: 439,652

[22] Filed: May 12, 1995

Related U.S. Application Data

[63] Continuation of Ser. No. 944,124, Sep. 11, 1992, abandoned.

[30] Foreign Application Priority Data

Sep. 11, 1991 [JP] Japan ..... 3-231507

[51] Int. Cl.[6] ..... G10L 5/02; G10L 9/00; G10L 3/02

[52] U.S. Cl. ..... 395/2.69; 395/2.31

[58] Field of Search ..... 395/2.39, 2.47, 395/2.52, 2.54, 2.09, 2.69, 2.58, 2.59, 2.63, 2.64, 2.31, 2.3; 381/43

[56] References Cited

U.S. PATENT DOCUMENTS 4,736,429 4/1988 Niyada et al. ..... 381/43
4,802,224 1/1989 Shiraki et al. ..... 395/2.54
5,202,926 4/1993 Miki ..... 395/2.58
5,204,905 4/1993 Mitome ..... 381/52
5,220,629 6/1993 Kosaka et al. ..... 381/52

*Primary Examiner*—Allen R. MacDonald
*Assistant Examiner*—Richemond Dorvil
*Attorney, Agent, or Firm*—Fitzpatrick, Cella, Harper & Scinto

[57] ABSTRACT

An apparatus and method for processing vocal information includes an extractor for extracting a plurality of spectrum information from parameters for vocal information, a vector quantizer for vector-quantizing the extracted spectrum information and for producing a plurality of parameter patterns therefrom, a memory for storing the plurality of parameter patterns so obtained, and a memory for storing positional information indicating the positions at which the plurality of parameter patterns are stored and for storing code information specifying parameter patterns and corresponding to the positional information. The parameter patterns and code information can be used to synthesize speech. Because a small number of parameter patterns are used, only a small memory capacity is needed and efficient processing of vocal information can be performed.

11 Claims, 5 Drawing Sheets

$(X(m) \mid 0 \leq m < M) \in (0, 1, 2, \cdots, K)$

FIG. 6

| | | |
|---|---|---|
| ----- | C (m) | ----- |
| ----- | $b_0(m)$ | ---- |
| ---- | X (m) | ---- |

BEFORE CONVERSION

| | | |
|---|---|---|
| ---- | C (m) | ---- |
| ---- | $b_0(m)$ | ---- |
| ---- | $b'_1(X(m))$ | ---- |
| ---- | $b'_2(X(m))$ ⋮ $b'_n(X(m))$ | ---- |
| ---- | $b'_{N-1}(X(m))$ | ----- |

AFTER CONVERSION

METHOD AND APPARATUS FOR SPEECH PROCESSING

This application is a continuation, of application Ser. No. 07/944,124 filed Sep. 11, 1992 now abandoned.

BACKGROUND OF THE INVENTION

1. Field of the Invention

The present invention relates to a method for analyzing, storing and synthesizing voice sound information and an apparatus embodying such a method.

2. Description of the Related Art

Hitherto, there has been developed a speech synthesis-by-rule method for generating voice sounds from character string data. In this method, feature parameters, such as LPC, PARCOR, LSP, or MEL CEPSTRUM (these will be hereinafter referred to simply as parameters), of phonemes stored in a phoneme file are read out in accordance with information on character string data. The feature parameters and driving sound source signals (i.e., an impulse series in voiced sound sections, and noise in unvoiced sound sections) are expanded or compressed on the basis of a fixed rule according to the rate at which voice sounds are synthesized. By supplying these signals to a speech synthesizer, a synthesized voice is obtained.

CV (consonant-vowel) phonemes, CVC (consonant-vowel-consonant) phonemes, and VCV (vowel-consonant-vowel) phonemes are commonly used as the form of phonemes for producing a synthesized voice. In particular, when long-unit phonemes, such as CVC phonemes or VCV phonemes, are used, large amounts of memory for storing phonemes are required. For this reason, a vector quantization method is effective for efficiently managing phoneme parameters.

In the vector quantization method, patterns of various parameters are previously determined by using a clustering technique, and codes are assigned to them. A table showing the correspondence between these codes and patterns is called a code book. A parameter is determined for each frame for an input voice sound. This parameter is compared with each pattern which has been previously determined, and the parameter is represented for the section of the frame to be expressed, by a code having the highest similarity thereto. The use of this vector quantization method enables various voice sounds to be expressed by using a limited number of patterns, thus making it possible to efficiently compress data.

However, in the conventional vector quantization method, since quantization is performed by using all dimensions of parameters, patterns are produced in such a manner that minute data characteristics for each dimension are ignored.

Parameters include power information about the intensity of a voice sound and spectrum information about acoustic information of a voice sound. Essentially, these two types of information are completely independent of each other and should be treated separately. However, in the prior art, these two types of information are treated collectively as one vector without any differentiating being made between them, and patterns are produced on this basis. In such a conventional method, when, for example, the power of a voice sound varies, even if "a" is voiced (for example, when voiced in loud and thin voices), different patterns must be produced even if they have the same spectrum structure. As a result, a large number of redundant patterns are stored in the code book, the capacity of the code book must be increased, and it takes a long time to search for patterns in the code book.

SUMMARY OF THE INVENTION

It is an object of the present invention to overcome the deficiencies in the prior art.

It is still another object of the present invention to provide an apparatus and method for processing vocal information so as to prevent deterioration of elements of the vocal information during compression of vocal data.

It is another object of the present invention to prevent deterioration of vocal information during a compression operation by extracting spectrum information from the vocal information and vector-quantizing the extracted spectrum information.

It is still another object of the present invention to increase the compression ratio of the vocal information.

It is another object of the present invention to increase the compression ratio of vocal information by managing parameter patterns produced by vector quantizing spectrum information, using code numbers.

It is another object of the present invention to perform efficient speech synthesis by decomposing text data into phonemic information and producing parameters containing code information which are used for speech synthesis from this phonemic information.

It is another object of the present invention to provide an apparatus and method for synthesizing speech that does not require a large number of redundant patterns to be stored in a code book, that uses a code book of a small capacity, and that searches a short period of time for patterns in the code book to synthesize speech.

According to one aspect, the present invention which achieves one or more of these objectives relates to a method for processing vocal information comprising the steps of extracting a plurality of spectrum information from parameters for vocal information, vector-quantizing the extracted plurality of spectrum information to produce a plurality of parameter patterns, storing the plurality of parameter patterns obtained by vector quantization from the plurality of spectrum information and storing positional information indicating the positions where the parameter patterns are stored and storing code information specifying the plurality of parameter patterns and corresponding to the positional information.

The vocal information can be phoneme information. In addition, the method can further comprise the step of representing the phoneme information by power information and code information and storing the power information and the code information as phoneme data. The method can further comprise the steps of extracting the phoneme information from input text information, extracting the code information corresponding to the phoneme information from the stored phoneme data, and synthesizing the parameter patterns according to the code information.

According to another aspect, the present invention which achieves at least one of these objectives relates to an apparatus for processing vocal information, comprising means for extracting spectrum information from parameters for vocal information, means for vector-quantizing the extracted spectrum information and for producing a plurality of parameter patterns therefrom, parameter patterns storing means for storing the plurality of parameter patterns obtained by vector quantization from the plurality of spectrum information, and storing means for storing positional information indicating the positions at which the plurality of parameter patterns are stored and for storing code information specifying the plurality of parameter patterns and corresponding to the positional information.

The vocal information can be phoneme information. In addition, the apparatus can further comprise phoneme data storing means for storing phoneme information represented by power information and code information as phoneme data. The apparatus can also comprise synthesizing means for extracting phoneme information from input text information, extracting code information corresponding to the phoneme information from the stored phoneme data, and synthesizing the parameter patterns according to the code information.

Other objectives, features, and advantages in addition to those discussed above will become more apparent from the following detailed description of the preferred embodiments taking in conjunction with the accompanying drawings.

BRIEF DESCRIPTION OF THE DRAWINGS

FIG. 6 is a view illustrating an example in which parameters are converted by a parameter conversion section of the present invention.

DESCRIPTION OF THE PREFERRED EMBODIMENTS

Preferred embodiments of the present invention will be explained below with reference to the accompanying drawings.

[Explanation of a method for generating patterns (FIGS. 1 to 4)]

Figure 1:
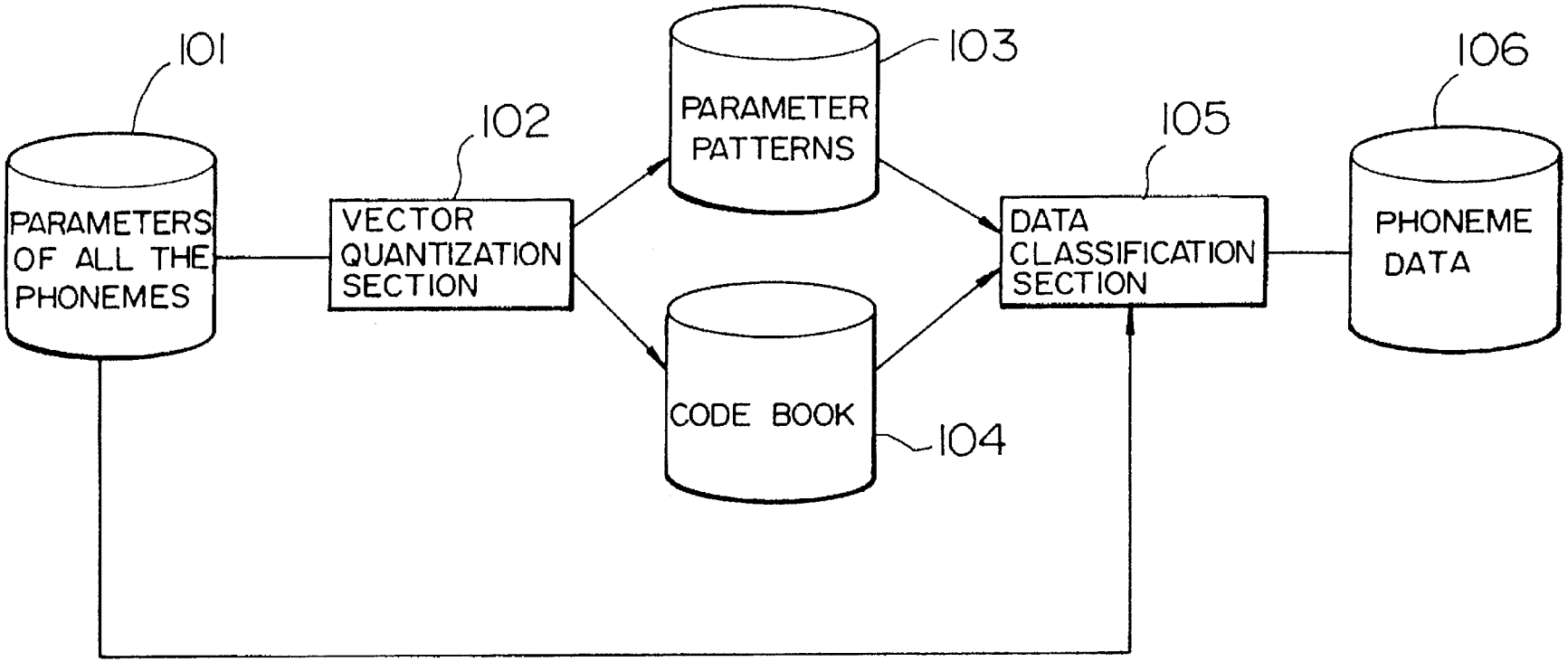
FIG. 1 is an illustration for showing a method for producing patterns by vector quantization according to a typical embodiment of the present invention.

FIG. 1 is an illustration for showing a method for producing patterns by vector quantization according to a typical embodiment of the present invention. In FIG. 1, reference numeral 101 denotes parameters of all the phonemes required for synthesis by rule; reference numeral 102 denotes a vector quantization section; reference numeral 103 denotes parameter patterns obtained by vector quantization; reference numeral 104 denotes a code book; reference numeral 105 denotes a data classification section for classifying parameters of all the phonemes according to the parameter patterns 103 and converting them into codes specified by the code book 104; and reference numeral 106 denotes compacted phoneme data.

Figure 2:
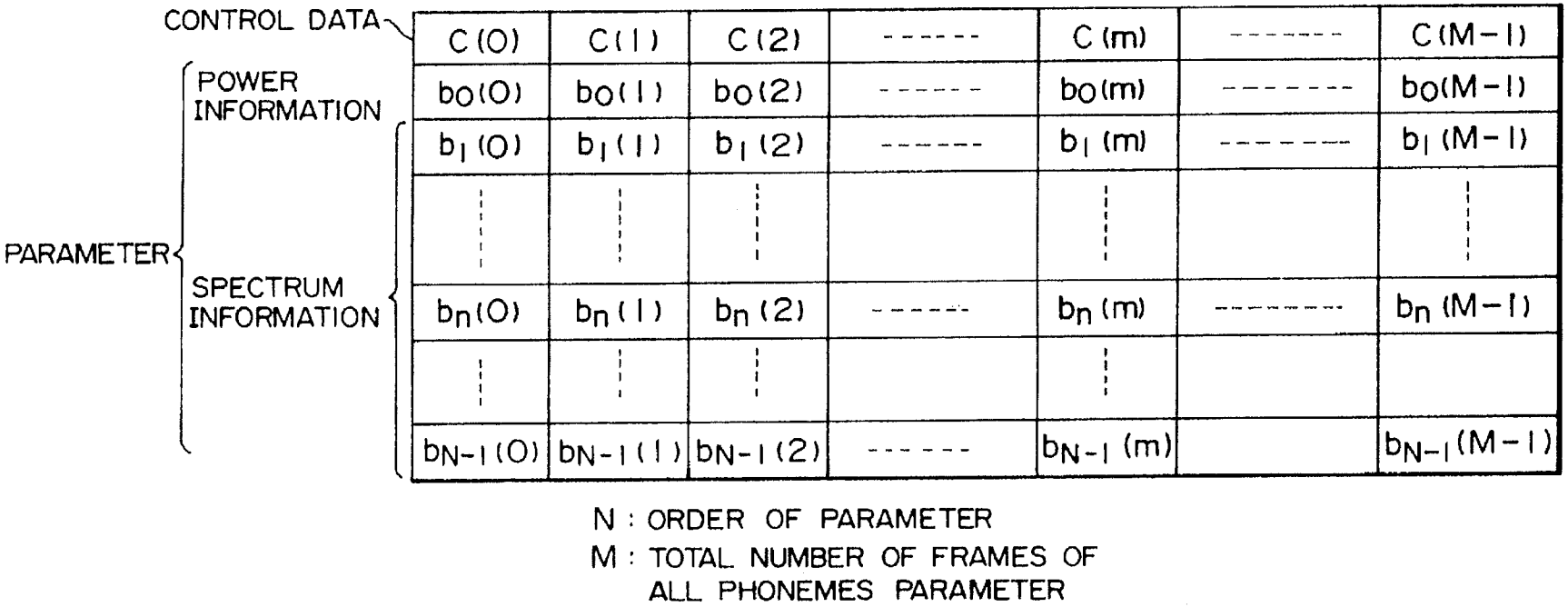
FIG. 2 shows a table illustrating the data structure of parameters of all the phonemes 101.

Referring to FIG. 1, first, a method for producing patterns by vector quantization will be explained. It will now be assumed that parameters of all the phonemes 101 are formed into the data structure shown in FIG. 2. In FIG. 2, data of each frame is formed of control data c(m) and parameter data $\{bi(m):0 \leqq i \leqq N-1\}$. The parameter data is formed of power data b0(m) and spectrum data $\{bi(m):1 \leqq i \leqq N-1\}$. There is sufficient data to vector quantize the total number of frames of all phoneme parameters.

The vector quantization section 102 vector-quantizes spectrum data $\{bi(m):1 \leqq i \leqq N-1\}$ of the parameters of all the phonemes 101 shown in FIG. 2. In this embodiment, power data is excluded from this process, and vector quantization is performed only by vector data. It is assumed that the vector quantization operation is performed by using well-known technology.

Figure 3:
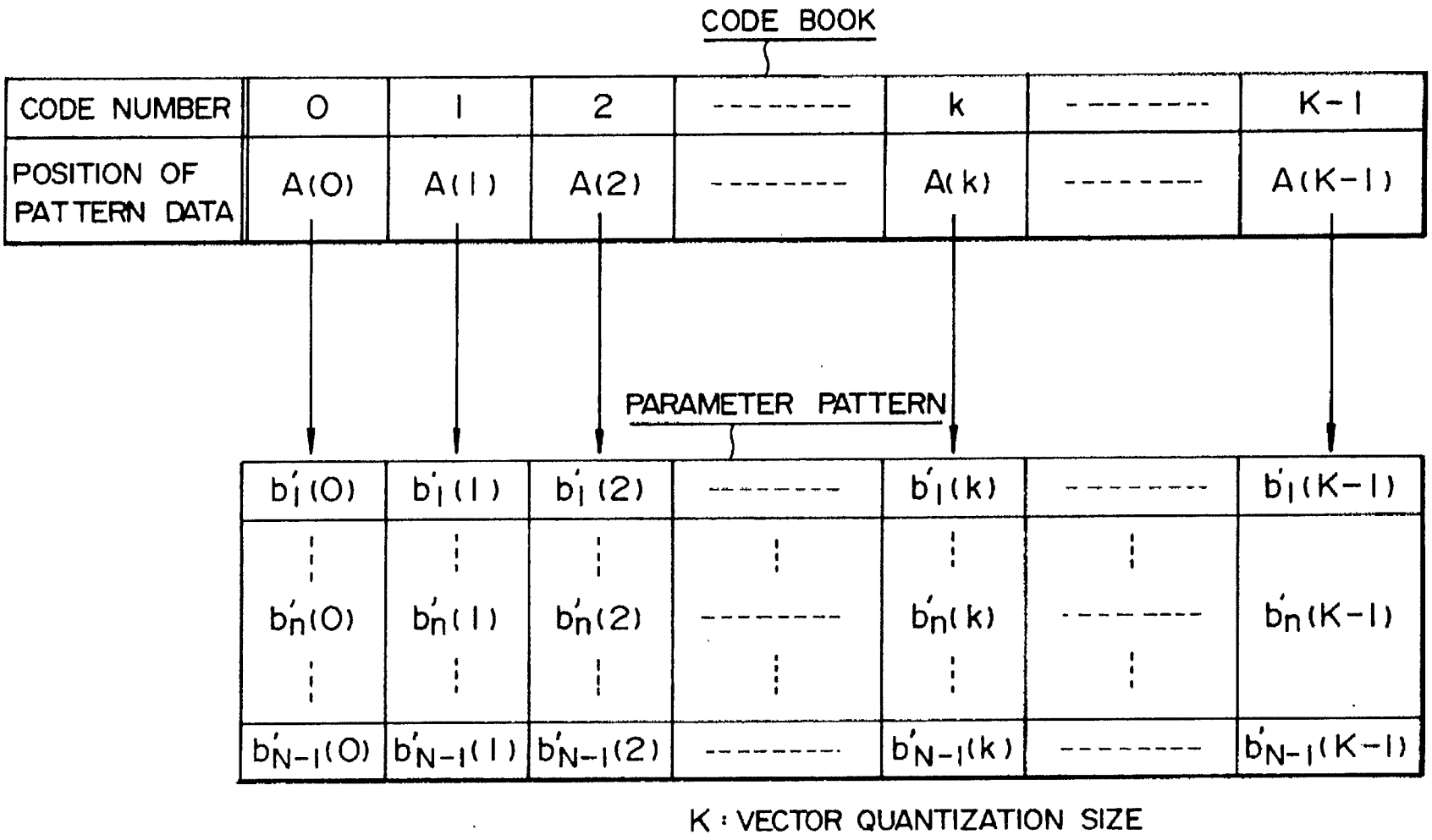
FIG. 3 shows tables illustrating the structure of a code book 104 and parameter patterns 103.

Results of the quantization operation performed by the vector quantization section 102 are stored in respective areas of a memory for storing the parameter patterns 103 and the code book 104. FIG. 3 shows the structure of the parameter patterns 103 and that of the code book 104. The parameter patterns 103 are patterns obtained by the vector quantization section 102 which uses centroid vectors which are divided by the vector quantization operation. Therefore, the number of patterns is equal to the quantization size. The code book 104 is formed into a table form in which are stored codes (usually sequential numbers are used) assigned to the parameter patterns 103 and pattern positions (addresses) within the parameter patterns 103, which positions correspond to the codes.

Figure 4:
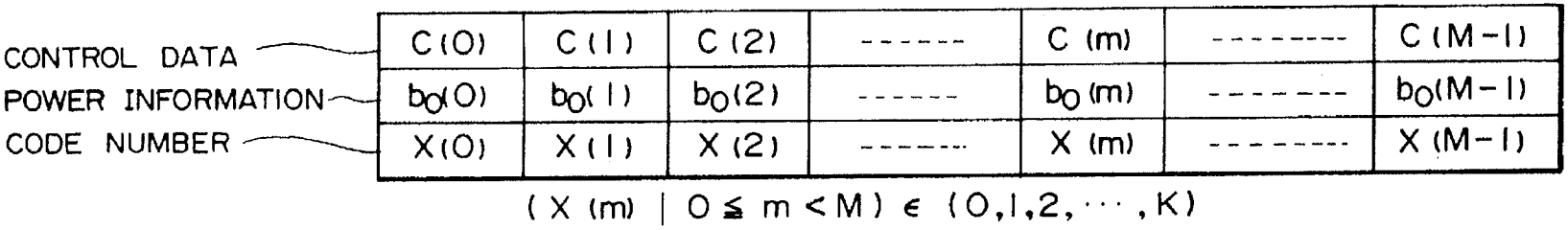
FIG. 4 shows a table illustrating the structure of phoneme data 106.

After the parameter patterns 103 and the code book 104 are produced, the parameters of all the phonemes 101 are compressed by the data classification section 105. First, vector distances between the spectrum data $\{bi(m):1 \leqq i \leqq N-1\}$ and all pattern data of the parameter patterns 103 are calculated for all the frames of the parameters of all the phonemes 101. The parameter pattern whose vector distance from the spectrum data is shortest is selected. Then, the code of this parameter pattern is obtained by using the code book 104. Next, the spectrum data portion of the parameters of all the phonemes 101 is replaced with that code, and phoneme data 106 is generated. As shown in FIG. 4, the data of each frame of the phoneme data 106 is represented by control data, power data and code data, thus reducing the amount of data for each frame.

[Explanation of a speech synthesis-by-rule apparatus (FIGS. 5 and 6)]

A speech synthesis-by-rule apparatus which uses phoneme data obtained by applying the above-described method will be explained with reference to the block diagram shown in FIG. 5.

Figure 5:
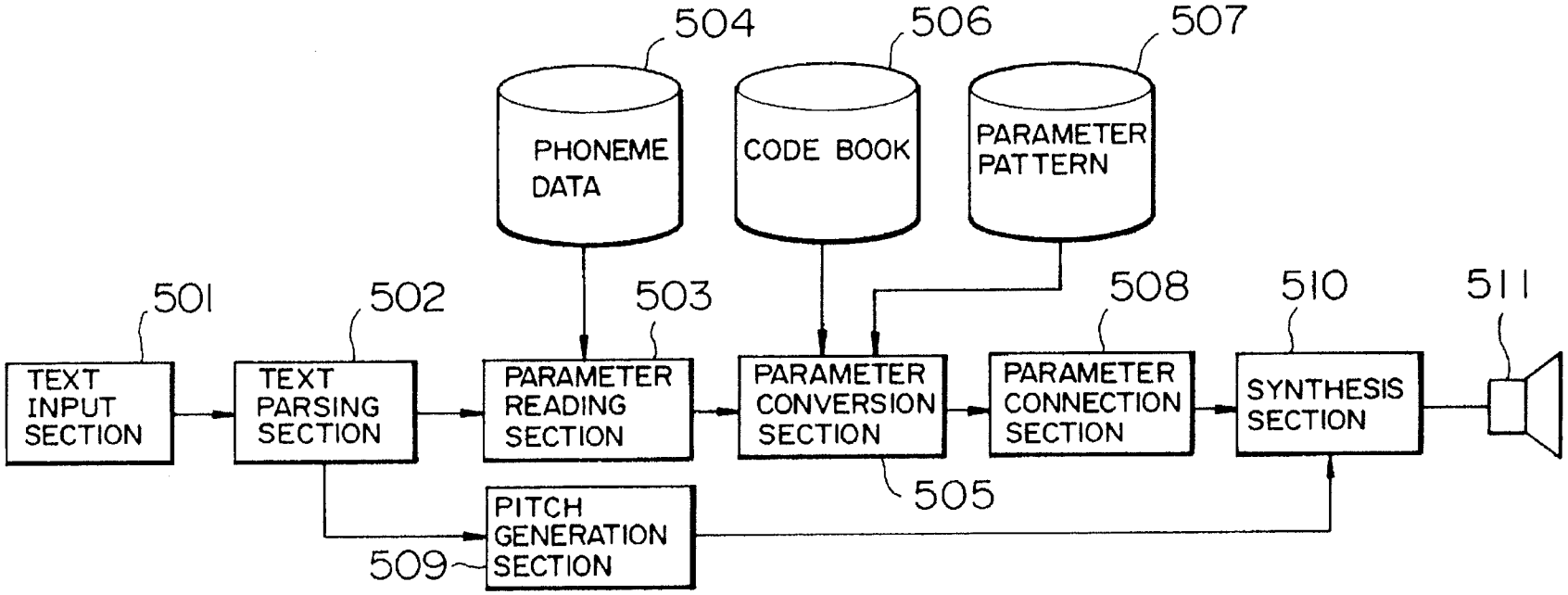
FIG. 5 is a block diagram illustrating the construction of a speech synthesis-by-rule apparatus.

The speech synthesis-by-rule apparatus shown in FIG. 5 performs speech synthesis by using vector-quantized patterns, a code book and phoneme data. In FIG. 5, reference numeral 501 denotes a text input section for inputting character strings; reference numeral 502 denotes a text parsing section for parsing input character strings and decomposing these into phonemic strings, and for parsing control codes (codes for controlling accent data and speech speed) contained in the text; reference numeral 503 denotes a parameter reading section for reading parameters of the phonemic strings and the phoneme data; reference numeral 504 denotes phoneme data stored in a memory and obtained by vector quantization; reference numeral 505 denotes a parameter conversion section for converting codes in the parameters which are read in by the parameter reading section 503 into all parameter patterns; reference numeral 506 denotes a code book stored in a memory and obtained by vector quantization; reference numeral 507 denotes parameter patterns obtained by vector quantization; reference numeral 508 denotes a parameter connection section for receiving parameters converted by the parameter conversion section and producing a connected parameter series; reference numeral 509 denotes a pitch generation section for generating pitches on the basis of the control information obtained by the text parsing section 502; reference numeral 510 denotes a speech synthesis section for synthesizing speech waveforms on the basis of the connected parameter series and pitch data; and reference numeral 511 denotes a speech output section for outputting speech waveforms.

Text to be speech-synthesized is input via the text input section 501. It is assumed that the text has control codes for controlling accent data and speech speed inserted into a character string represented in the Roman alphabet or Kana characters. However, in the case where a sentence, in which Kanji and Kana characters are mixed, is output as speech, a sentence parsing section is provided in the anterior portion of the text input section 501, whereby kanji-kana-mixed sentences are converted into a form that can be read by the text input section 501.

Text inputted by the text input section 501 is parsed by the text parsing section 502 and decomposed into information representing reading data (hereinafter referred to as phonemic series information) and control information, such as accent positions or the speech rate. The phonemic series information is input to the parameter reading section 503. The parameter reading section 503 first reads out phoneme parameters from the phoneme data 504 in accordance with the phonemic series information. The phoneme data read out at this time has the structure shown in FIG. 4 in which spectrum information is stored as codes. The parameter conversion section 505 selects the most appropriate pattern from the parameter patterns 507 by referring to the code book 506 on the basis of this code and replaces the code with the pattern. As a result, phoneme data is converted into data having the structure shown in FIG. 6.

Next, phoneme data is arranged so that mora (the minimal unit of quantitative measure in temporal prosodic systems equivalent in the time value to an average short syllable) exist in equal intervals in the parameter connection section 508. A parameter interpolation operation is performed between all adjacent phonemes, and connected parameter series are produced. The pitch generation section 509 generates a pitch series in accordance with the control information from the text parsing section 502. Speech waveforms are generated by the speech synthesis section 510 on the basis of the pitch series and the parameter series obtained by the parameter connection section 508. The speech synthesis section 510 may be formed of digital filters. The speech waveforms produced are output as speech by the speech output section 511.

As has been explained above, according to this embodiment, synthesized speech can be generated by using parameter patterns compressed by vector quantization by using only phoneme data comprising a small amount of data, a code book and parameter spectrum information.

The present invention may be applied to a system formed of a plurality of components, or to an apparatus formed of one component. Needless to say, the present invention can be applied to a case where the object thereof can be achieved by supplying programs to a system or an apparatus.

Many different embodiments of the present invention may be constructed without departing from the spirit and scope of the present invention. It should be understood that the present invention is not limited to the specific embodiment described in this specification. To the contrary, the present invention is intended to cover various modifications and equivalent arrangements included within the spirit and scope of the claims. The following claims are to be accorded a broad interpretation, so as to encompass all such modifications and equivalent structures and functions.

The individual components represented by the blocks shown in FIGS. 1 and 5 are well known in the speech processing art and their specific construction and operation is not critical to the invention or the best mode for carrying out the invention. Moreover, the steps recited in the specification for carrying out the present invention can be easily programmed into well-known central processing units by persons of ordinary skill in the art and since such programming per se is not part of the invention, no further description thereof is deemed necessary.

What is claimed is:

1. A method for using a memory stored with vocal information generated by the steps of:

providing parameter data of phonemes, the parameter data including power data and spectrum data;

vector-quantizing the spectrum data to produce a plurality of parameter patterns;

storing the plurality of parameter patterns obtained by vector quantization of the spectrum data; and storing positional information indicating the positions where the parameter patterns are stored and storing code information specifying the plurality of the parameter patterns corresponding to the positional information;

said method comprising the steps of:

inputting text;

decomposing the inputted text into phonemic series information;

reading out phoneme parameters from stored phoneme data in accordance with the phonemic series information, the phonemes parameters including spectrum information in the form of codes; and converting the codes in the phoneme parameters into a pattern by selecting a pattern from the plurality of stored parameter patterns by referring to the stored positional information in accordance with code information of the read out phoneme parameters.

2. A method for speech processing according to claim 1, wherein the vocal information is phoneme information.

3. A method for speech processing according to claim 2, further comprising the steps of representing the phoneme information by power information and code information, and storing the power information and code information as phoneme data.

4. A method for speech processing according to claim 3, further comprising the steps of extracting the phoneme information from input text information, extracting the code information corresponding to the phoneme information from the stored phoneme data, and synthesizing the parameter patterns according to the code information.

5. A method for speech processing according to claim 1, further comprising the step of synthesizing speech waveforms on the basis of said selected pattern and outputting the waveforms.

6. A method according to claim 1, further comprising the step of providing a memory medium for storing a program to perform said providing, vector-quantizing, storing, inputting, decomposing, reading-out and converting steps.

7. An apparatus for processing vocal information, comprising:

means for generating and storing vocal information comprising:

means for providing parameter data of phonemes, the parameter data including power data and spectrum data;

means for vector-quantizing the spectrum data to produce a plurality of parameter patterns;

means for storing the plurality of parameter patterns obtained by vector quantization of the spectrum data; and means for storing positional information indicating the positions where the parameter patterns are stored and storing code information specifying the plurality of the parameter patterns corresponding to the positional information;

means for inputting text into said apparatus;

means for decomposing the text into phonemic series information;

means for reading out phoneme parameters from stored phoneme data in accordance with the phonemic series information, the phoneme parameters including spectrum information in the form of codes; and means for converting the codes in the phoneme parameters into a pattern by selecting a pattern from the plurality of stored parameter patterns by referring to the stored positional information in accordance with code information of the read out phoneme parameters.

8. An apparatus for processing vocal information according to claim 7, wherein the vocal information is phoneme information.

9. An apparatus for processing vocal information according to claim 7, further comprising phoneme data storing means for storing phoneme information represented by power information and code information as phoneme data.

10. An apparatus for processing vocal information according to claim 7, further comprising synthesizing means for extracting phoneme information from input text information, extracting code information corresponding to the phoneme information from the stored phoneme data, and synthesizing the parameter patterns according to the code information.

11. An apparatus for processing vocal information according to claim 7, further comprising the step of synthesizing speech waveforms on the basis of said selected pattern and outputting the waveforms.

* * * * *

UNITED STATES PATENT AND TRADEMARK OFFICE

CERTIFICATE OF CORRECTION

PATENT NO. : 5,633,984
DATED : May 27, 1997
INVENTOR(S) : METHOD AND APPARATUS FOR SPEECH PROCESSING

It is certified that error appears in the above-identified patent and that said Letters Patent is hereby corrected as shown below:

Column 6, line 27, delete "phonemes" and insert therefor --phoneme--.

lines 34, 36, 41, and 47, delete "for speech processing".

Signed and Sealed this

Twenty-third Day of December, 1997

Bruce Lehman

*Attest:*

BRUCE LEHMAN

*Attesting Officer*

*Commissioner of Patents and Trademarks*